US007178560B2

(12) United States Patent
Bamelis et al.

(10) Patent No.: US 7,178,560 B2
(45) Date of Patent: Feb. 20, 2007

(54) DEVICE AND METHOD FOR INSERTING WEFT THREADS IN A WEAVING MACHINE, AND THREAD CLAMP USED THEREWITH

(75) Inventors: Jean Marie Bamelis, Ieper (BE); Chris Delanote, Ieper (BE); Jozef Peeters, Ieper (BE); Herman Salomez, Zonnebeke (BE)

(73) Assignee: Picanol N.V., naamloze vennootschap, Ieper (BE)

( * ) Notice: Subject to any disclaimer, the term of this patent is extended or adjusted under 35 U.S.C. 154(b) by 169 days.

(21) Appl. No.: 10/476,882

(22) PCT Filed: May 17, 2002

(86) PCT No.: PCT/BE02/00080

§ 371 (c)(1),
(2), (4) Date: Nov. 14, 2003

(87) PCT Pub. No.: WO02/095106

PCT Pub. Date: Nov. 28, 2002

(65) Prior Publication Data

US 2004/0154685 A1 Aug. 12, 2004

(30) Foreign Application Priority Data

May 21, 2001 (BE) ..... 2001/0348

(51) Int. Cl.
*D03D 47/30* (2006.01)

(52) U.S. Cl. ..... 139/453.1

(58) Field of Classification Search ..... 139/435.1, 139/161.1, 435.4, 429
See application file for complete search history.

(56) References Cited

U.S. PATENT DOCUMENTS

| | | | | |
|---|---|---|---|---|
| 4,512,375 | A * | 4/1985 | Deborde et al. | 139/435.3 |
| 4,722,370 | A * | 2/1988 | Manders | 139/429 |
| 5,529,094 | A * | 6/1996 | Nishimura et al. | 139/435.1 |
| 6,014,992 | A * | 1/2000 | Speich | 139/435.1 |
| 6,223,783 | B1 * | 5/2001 | Peeters et al. | 139/435.4 |

OTHER PUBLICATIONS

Lord, Weaving: Conversion of Yarn to Fabric, 1973, Merrow Publishing, p. 371.*

* cited by examiner

*Primary Examiner*—Gary L. Welch
*Assistant Examiner*—Andrew W. Sutton
(74) *Attorney, Agent, or Firm*—Bacon & Thomas, PLLC

(57) ABSTRACT

A device for inserting weft threads in an airjet weaving machine including at least one main blower and a respective thread clamp associated with the main blower. The thread clamp is constituted of an element configured in a modular form. Such modular form enables several such elements to be assembled in a modular configuration, including one on top of another. Pneumatically actuated elements are used to engage and disengage the thread clamps whereby the thread clamps may be engaged or disengaged by pressure and vacuum supplied through a single supply conduit. A method for inserting weft threads in the shed of an airjet weaving machine includes holding each weft thread at least temporarily in a thread clamp that moves with the sley of the weaving machine and using a thread tensioner outside the shed at a location between the thread supply and the thread clamp. A further method of inserting weft threads includes supplying the main blower temporarily with a lower pressure before insertion of the weft thread by the main blower when the thread clamp holding the thread is opened.

18 Claims, 4 Drawing Sheets

DEVICE AND METHOD FOR INSERTING WEFT THREADS IN A WEAVING MACHINE, AND THREAD CLAMP USED THEREWITH

BACKGROUND OF THE INVENTION

A. Field

This invention relates to a device and method for inserting weft threads in a weaving machine, more particular an airjet weaving machine, as well as to a thread clamp used therewith.

B. Related Art

It is generally known that with airjet weaving machines, the weft thread is formed of weft yarn which is supplied from a thread supply, usually a bobbin, and that such weft thread is inserted into the so-called shed by means of air and by means of one or more main blowers. Hereby, main blowers can be used which either are arranged next to the sley of the weaving machine, or are arranged on this sley. Also, a combination can be applied of several main blowers arranged one after the other, whereby in that case then mostly, however, not necessarily, one of the two is arranged next to the sley, whereas the other is provided on the sley. The first main blower then mostly has the function of a so-called auxiliary main blower.

It is also known that at such main blower, either in the immediate proximity thereof, or integrated therein, a thread clamp can be provided, which substantially is intended for holding the weft thread concerned, preceding each insertion, with its front extremity in the main blower. Known embodiments thereof are described, amongst others, in the patent documents CS 273.523, FR 2.535.745, JP 51-43663, JP 51-43664, JP 11-107122, JP 11-107123 and WO 97/12084.

The known embodiment have the disadvantage that they are relatively inflexible in their use, in particular if different units of main blowers, each provided with a respective thread clamp, must be mounted next to each other.

The invention aims at a device for inserting weft threads in a weaving machine which does not have the aforementioned disadvantage.

BRIEF SUMMARY OF THE INVENTION

To this aim, the invention relates to a device for inserting weft threads in a weaving machine, more particularly an airjet weaving machine, which device comprises at least one main blower with a respective thread clamp, with the characteristic that the thread clamp forms part of an element configured in a modular manner, whereby this element, configured in a modular manner, in itself may comprise one or more thread clamps. By using such elements, configured in a modular manner, the advantage is created that several thread clamps or groups of thread clamps can be assembled as one modular group in a compact manner. Moreover, the number of thread clamps per group can easily be increased, simply by increasing the number of modular elements. Another advantage is that in case of a defect in a thread clamp, only a limited number of parts, more particularly the element configured in a modular manner which comprises this thread clamp, must be replaced.

Preferably, the element configured in a modular manner comprises means which permit several of such elements to be assembled in a modular manner on top of each other. In this way, the number of modular elements, and, thus, also the number of thread clamps, easily can be increased, for example, if several main blowers are installed, simply by providing additional modular elements below or above the modular elements already present.

In a practical form of embodiment, the element configured in a modular manner comprises two thread clamps situated laterally adjacent to each other. By laterally is meant that they are situated in a substantially horizontal plane and/or in a plane extending substantially tangential in respect to the movement of the sley. As a consequence, a configuration is obtained which is particularly efficient in its application.

According to a preferred form of embodiment, each respective thread clamp of such element, configured in a modular manner, comprises a thread passage, as well as actuation means for controlling the thread clamp, and the whole is designed such that these actuation means are situated substantially laterally adjacent to the respective thread passage, more particularly are situated in a plane which extends substantially tangential in respect to the movement of the sley. In this manner, the space taken by the actuation means is limited in height to a minimum, which allows providing several elements, configured in a modular manner, each with one or more thread clamps, on top of each other, such that the thread passages of the thread clamps situated above each other will not be situated at a large distance from each other.

In the most preferred form of embodiment, such as aforementioned, two thread clamps per module situated laterally adjacent to each other are, and these two thread clamps are provided with actuation means which are situated opposed in respect to the two respective thread passages then situated in between.

This provides the advantage that the thread passages remain located in their mutual proximity, as a consequence of which also the main blowers cooperating therewith can be mounted in their mutual proximity, which, as known, is advantageous, as all these main blowers must blow through their outlet along the length of the relatively small air-guide channel of the reed.

According to an important preferred characteristic of the invention, the device is characterized in that each respective thread clamp is provided with clamping parts for a thread and of actuation means formed by a movable body cooperating with at least one of the clamping parts; in that said body can be moved between at least two positions, a position in which the clamping parts are forced towards each other, and a position in which they are moved away from each other, respectively; and in that the body is formed as a small piston which can be moved in one direction by means of fluid pressure, while it can be moved in the other direction by means of a suction. By using actuation means with which the thread clamp can be brought into two positions by means of pressure, on one hand, and suction, on the other hand, respectively, such thread clamp, including its actuation means, constructively seen can be realized very simple, with a minimum of components, which contributes to the compactness of the whole. Moreover, this in its turn offers the advantage that a modular construction can be obtained in a relatively simple manner.

In the case that use is made of such actuation means, that is, actuation means allowing the thread clamp to be moved by means of, on one hand, pressure, and, on the other hand, suction, these actuation means preferably further do not comprise any other active or passive components in order to effect the movement of said body, which further contributes to the compactness of the whole.

In a practical form of embodiment, the small piston is formed as a plunger, whereby one extremity of this plunger directly functions as a clamping part. Thus, possible intermediate parts are not needed, which also enhances the compactness of the whole.

Also, it is preferred that each respective thread clamp has one and the same common connection for applying fluid pressure and suction. Thus, the number of connections is restricted.

According to another preferred characteristic, said device according to the invention is characterized in that each respective thread clamp is provided with clamping means for a thread and of actuation means formed by a body, cooperating with at least one of the clamping parts, which can be moved between two positions, in which the clamping parts are forced towards and away from each other, respectively, whereby this body can be moved according to a direction perpendicular or substantially perpendicular to the insertion direction of the thread. This perpendicular or substantially perpendicular arrangement offers the advantage that each thread clamp, and thus also the element, configured in a modular manner, to which it belongs, remains restricted in its dimensions in the longitudinal direction of the shed.

According to another preferred characteristic of the invention, the elements configured in a modular manner are formed as attachment and/or pre-fixable pieces which can cooperate with respective main blowers, in such a manner that each respective thread clamp comprises a thread passage in the form of a thread-feeding channel situated along the direction of the thread-feeding channel of the corresponding main blower. In this manner, a smooth assembly with the respective main blowers is possible. The main blowers, too, may be formed as modules or may form part of elements which can be assembled in a modular manner, for example, as described in the Belgian patent No. 1.011.183.

Although the elements configured in a modular manner, as aforementioned, preferably are formed as attachment and/or pre-fixable pieces, each element may also be configured in a modular manner in one piece with the respective main blowers.

The invention is particularly efficient in devices where the respective thread clamps are combined with one or more main blowers mounted on the sley of the weaving machine. On such sley, as known, there is relatively little space, and the application of a modular structure offers the advantage that this space is utilized in an optimum manner. The compactness of such modular structure also enables minimizing the weight of the whole and the occurring inertia forces during the movement of the sley.

In the case that, as aforementioned, a main blower mounted on the sley, with pertaining thread clamp, is used, according to a preferred from of embodiment, along the weft yarn mostly supplied from a thread supply, such as a bobbin, a thread tensioner is installed between the thread supply and said thread clamp. In practice, this will be preferably a fixedly installed thread tensioner which is situated after the usual prewinder, however, before the main blower and possibly also before the auxiliary main blower. The use of such thread tensioner offers the advantage that the occurrence of limply hanging parts of weft yarn is excluded.

According to another form of embodiment, the device is characterized in that it comprises air supply means which permits at the main blower, an air supply with at least two pressures to be provided, an insertion pressure and a lower pressure, respectively, whereby these air supply means comprise control means which provide that, when opening the thread clamp and before the insertion of a weft thread by means of the insertion pressure, at least temporarily an air supply at the respective main blower is provided at said lower pressure, whereas during the closed condition of the thread clamp there is preferably a period in which the air supply to the respective main blower is completely or almost completely interrupted. On one hand, this avoids dropping out of the extremity of the weft yarn from the main blower when the thread clamp is opened before the insertion pressure is applied. At that moment, the thread end is held by the air flow at lower pressure. On the other hand, blowing apart of the tip of the weft yarn present in the main blower is avoided, which, for example, might occur when the insertion pressure is applied while the respective thread clamp still closed. By completely switching off the air supply during the clamping of the thread, the air supply at lower pressure will not cause any damage of the thread.

The aforementioned is especially useful with very elastic yarns. Especially with such elastic yarns, it is, in fact, important to take measures that these yarns do not drop out of the main blower when the thread clamp opens. Threads consisting of elastic yarn, in fact, may jump back strongly when cut, and because at that moment, there is no air flow in the main blower, the extremity of the supplied weft yarn may accumulate at the inlet of the main blower or next to the thread clamp, with the consequence that, when substantially the thread clamp is opened, there is a high risk that the thread end drops out of the main blower. Due to the technique described in the aforegoing, this may be avoided in that, by switching-on the air supply at low pressure during the opening of the thread clamp, a sufficiently high force is created to retain the extremity in the main blower and/or to tension the accumulated part again.

Of course, the invention also relates to thread clamps which are suitable for being applied as a modular element in a device, as described in the aforegoing.

It is noted that said inventive idea to combine, on one hand, the application of a main blower, with pertaining thread clamp, attached on the sley with, on the other hand, a thread tensioner, preferably a thread tensioner fixedly arranged next to the sley, is not limited to the use of thread clamps which form a part of elements which are configured in a modular manner, as this inventive idea also can be realized with any kind of thread clamp. Also, the combination of such thread tensioner with other thread clamps on the sley, for example, at the end of the shed, is very useful, for the same reasons explained above. In consideration of this, the invention, according to a particular aspect, thus also relates to a method for inserting weft threads in a weaving machine, whereby each weft thread concerned is formed of weft yarn which is supplied from a thread supply, whereby this weft thread is brought into the shed by means of air and by means of one or more main blowers and whereby such weft thread, at least temporarily, is held in a thread clamp moving along with the sley of the weaving machine, with as a characteristic that the weft yarn, outside of the shed of the weaving machine and at a location between the thread supply and said thread clamp, is tensioned by means of a thread tensioner. Hereby, any thread clamp on the sley may be involved for example, a thread clamp cooperating with a main blower as well as a thread clamp arranged at the end of the shed, as well as thread clamps mounted on other locations on the sley.

Said thread tensioner may be an element exerting a certain tension force on the weft yarn, as well as a controlled element exerting a controlled tension, whether according to a well-defined course or not. Preferably, the thread tensioner is fixedly installed next to the sley.

It is also noted that said inventive idea to provide, (when opening the thread clamp before the application of the insertion pressure, first in an air supply with lower pressure in the main blower,) also is not limited to embodiments using thread clamps which form part of an element configured in a modular manner. This inventive idea, too, can in fact be applied in various devices for inserting weft threads in the shed of a weaving machine, regardless of which kind of thread clamp is used to this aim. According to a second particular aspect, the present invention further also relates to a method for inserting weft threads in a weaving machine, whereby the weft threads are brought into the shed by means of air and by means of one or more main blowers, whereby such weft thread, each time preceding the insertion thereof, is retained by means of a thread clamp at the respective main blower, and whereby air supply means are applied which allow that at the main blower, an air supply with at least two pressures can be provided, namely an insertion pressure and a lower pressure, respectively, with as a characteristic that, when opening the thread clamp and before the insertion of a weft thread by means of the insertion pressure, at least temporarily an air supply to the respective main blower is provided at said lower pressure.

For this lower pressure, the classical retaining air flow can be applied, which usually is present in weaving machines when no thread clamp is applied, and which then is switched on permanently in order to hold the weft thread in the main blower at those moments when no weft yarn must be inserted from this main blower.

DESCRIPTION OF THE DRAWINGS

With the intention of better showing the characteristics of the invention, hereafter, as examples without any limitative character, several preferred forms of the invention are described, with reference to the accompanying drawings, wherein.

DETAILED DESCRIPTION OF THE PREFERRED EMBODIMENTS OF THE INVENTION

Figure 1:
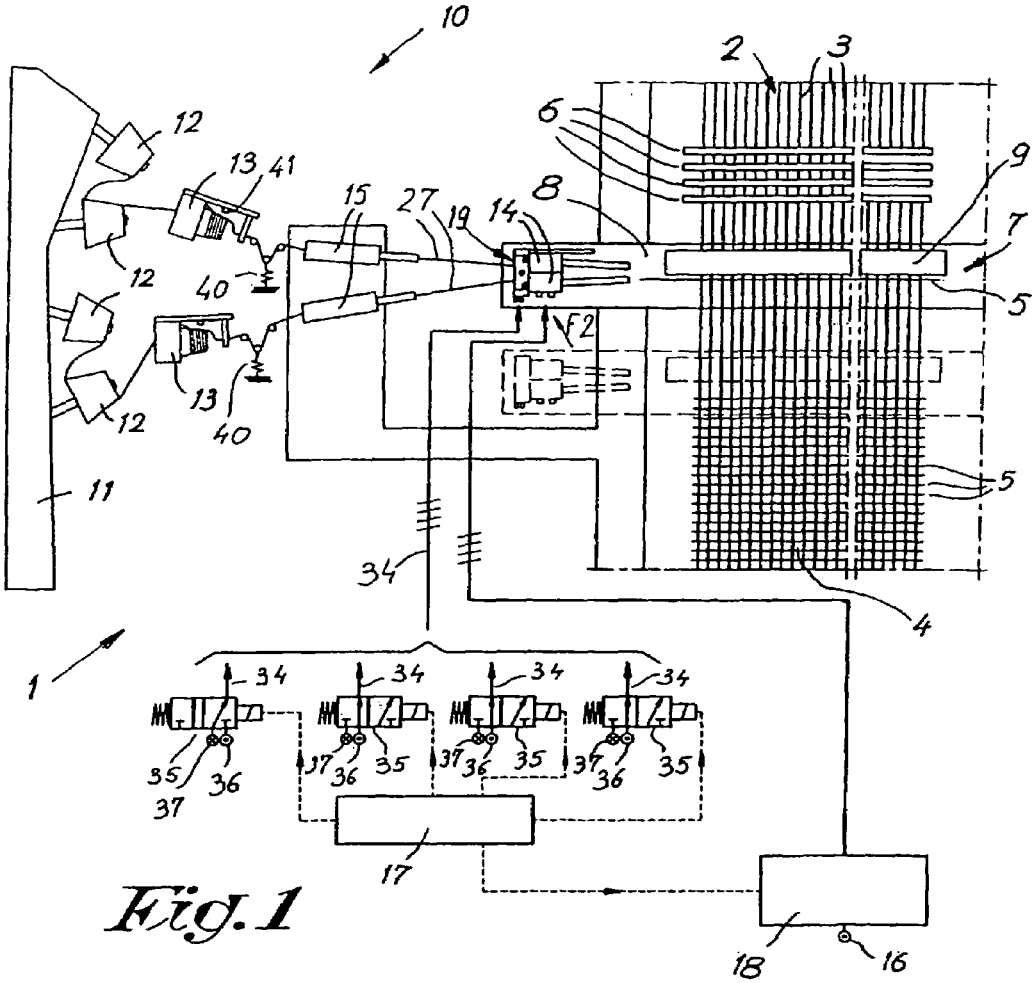
FIG. 1 in plan view schematically represents a device according to the invention.

FIG. 1 schematically and in plan view represents a part of a weaving machine 1, including the warp 2 with the warp threads 3, the woven fabric 4, formed by the warp threads 3 and weft threads 5 woven therein, the weaving frames 6, the shed 7 formed thereby, the to-and-fro arcuately movable sley 8 with the reed 9 and finally the device 10 for inserting the weft threads 5 in the shed 7.

The device 10 consists of a bobbin stand 11 with bobbins 12, prewinders 13, as well as main blowers, in this case, on one hand, classical main blowers 14 which are mounted on the sley 8, and, on the other hand, so-called auxiliary main blowers 15, fixedly mounted in front thereof, next to the sley 8. These main blowers 14 and auxiliary main blowers 15 are actuated by means of a connection to a compressed air source 16, by the intermediary of a valve system 18, which in its turn is commanded by a control system 17.

The particularity of the invention consists in that certain ones of the main blowers, in this case, the moving main blowers 14, are provided with thread clamps, in general indicated by reference 19 and, more specifically, by references 19A–19B–19C–19D, which, as represented more detailed in the example of FIG. 2 to 5, form part of one or more, in this case, two, elements 20 configured in a modular manner. By modular is meant that the thread clamp elements and their respective actuators and necessary ports and mounting structure are embodied in a unitary housing that is attachable and removable as a single assembly.

In the represented example, two of such elements 20 configured in a modular manner are provided on top of each other, this by means of means, provided to this aim, which allow such mounting. These means substantially consist of a support 21 on which the elements 20, configured in a modular manner, systematically can be provided on top of each other, as well as of bolts 22 extending through all elements 20 for tensioning and retaining said elements 20 on the support 21. The length of these bolts 22 can be chosen in function of the number of elements 20 configured in a modular manner which have to be mounted on top of each other.

Each element 20 comprises two thread clamps situated laterally adjacent to each other, in this case, 19A–19B and 19C–19D, respectively. According to not-represented variants, also one thread clamp or two or more thread clamps can be mounted next to each other on one and the same height level.

Each thread clamp 19A–19B–19C–19D comprises an enclosed thread passage 23, as well as actuation means 24 for opening and closing the respective thread clamp 19A–19B–19C–19D. These actuation means 24 preferably are situated, as represented, substantially laterally adjacent to the respective thread passage 23, in other words, they are situated, per thread clamp 19A–19B–19C–19D, in a plane extending substantially tangential to the movement of the sley 8 of the weaving machine 1, as a result of which, as aforementioned, the mounting height, per element 20 configured in a modular manner, is limited.

Figure 4:
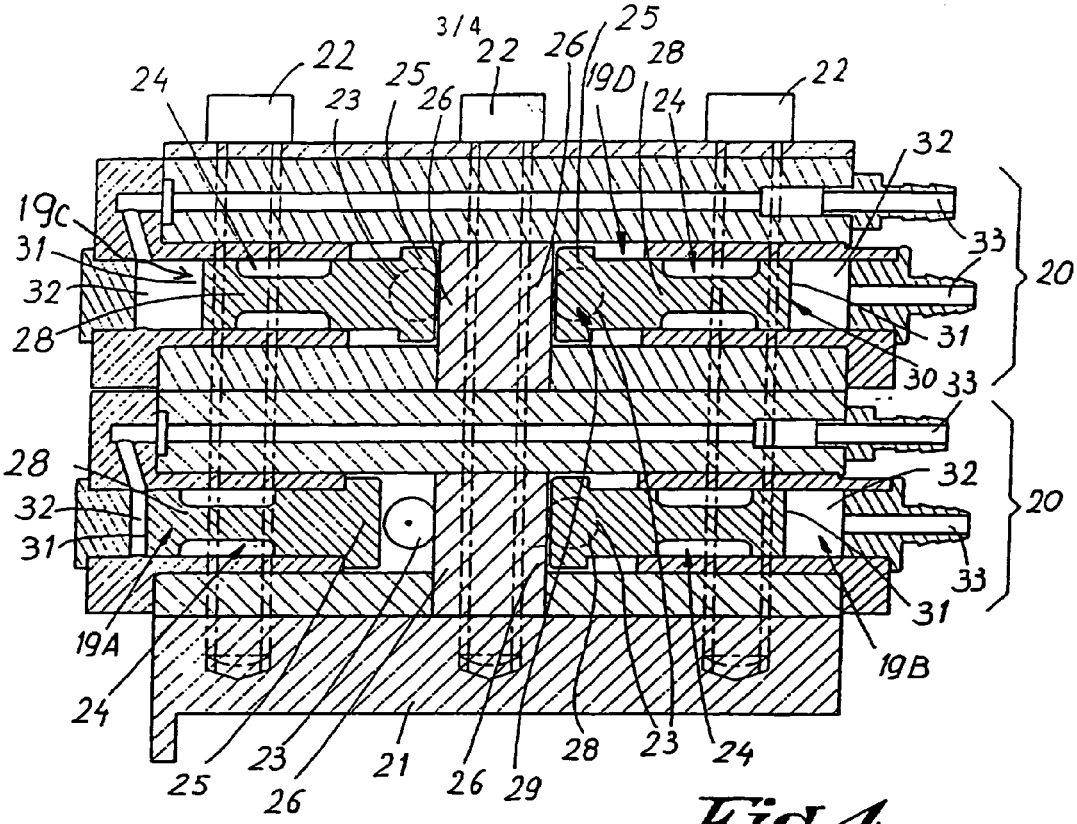
FIGS. 4 and 5 represent cross-sections taken along lines IV—IV and V—V in FIG. 3, respectively.
Figure 5:
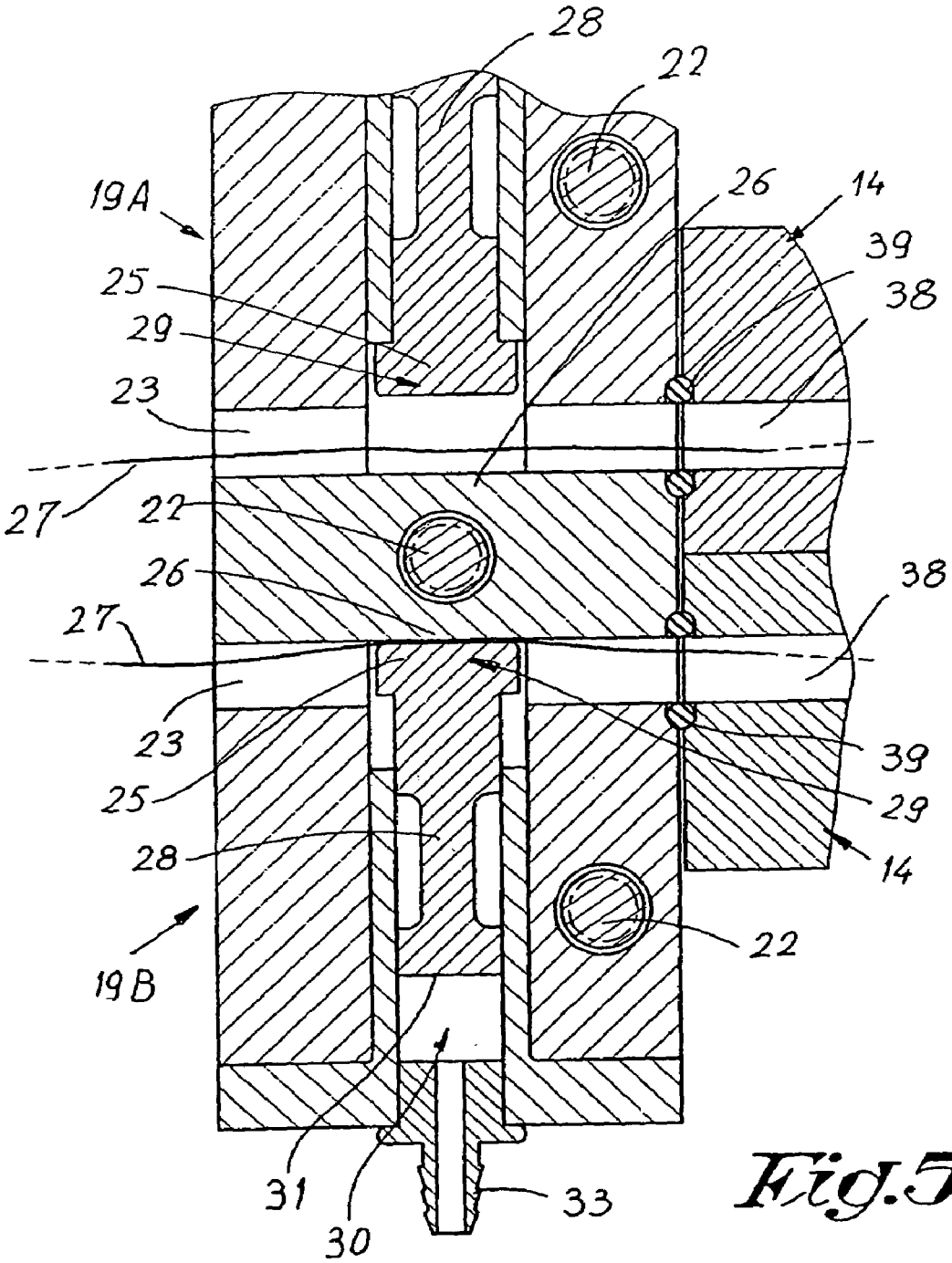

As is clearly visible in the FIGS. 4 and 5, each group of two thread clamps situated on one and the same level, 19A–19B and 19C–19D, respectively, comprises actuation means 24 which are situated opposed in respect to the respective thread passages 23 which then are situated in between.

The applied thread clamps 19A–19B–19C–19D and the actuation means applied therewith in themselves may be of different kind. For optimizing, however, the modular character of the whole, it is preferred that these are of the construction described in the following and represented in the figures.

Each thread clamp 19A–19B–19C–19D comprises two clamping parts 25–26 for a respective weft thread 5, originating from one of the supplied weft yarns 27, and the actuation means 24 are formed by a movable body 28 which cooperates with at least one of the clamping parts, in this case, the clamping part 25. This body 28, which can be moved between at least two positions, a position in which the clamping parts 25–26 are forced towards each other, and a position in which they are moved away from each other, respectively, is constructed as a small piston which, by means of overpressure (fluid pressure), can be moved in one direction, whereas it can be moved in the other direction by means of a negative pressure (suction).

The small piston is formed as a plunger, whereby one extremity 29 of this plunger directly functions as a clamping part 25, whereas the other extremity 30 forms a cylinder surface 31 which closes a cylinder chamber 32 in which, by means of a common connection 33, an overpressure or a negative pressure can be applied. As schematically illustrated in FIG. 1, each connection or port 33, by means of a conduit 34, is in connection with a valve 35 commanded by means of a control unit, in this case, the aforementioned control unit 17, which valve is, for example, a 3/2-valve, with which, responsive to actuation, a connection can be made to a supply 36 for a medium over pressure or to a supply 37 providing a negative pressure. The supply 36 may consist of a classical connection to a compressed air source, which can be the same as the compressed air source 16, or to a compressed air network with a supply pressure of, for example, two or three bar, whereas the supply 37 can provide for a connection to, for example, a vacuum pump which creates an absolute pressure of, for example, 0.2 bar.

As represented, the bodies 28 preferably are movable according to a direction perpendicular or substantially perpendicular to the insertion direction of the weft thread 5. This is also valid for other forms of the invention, not represented in the figures, for example, with electromagnetically movable bodies.

Figure 3:
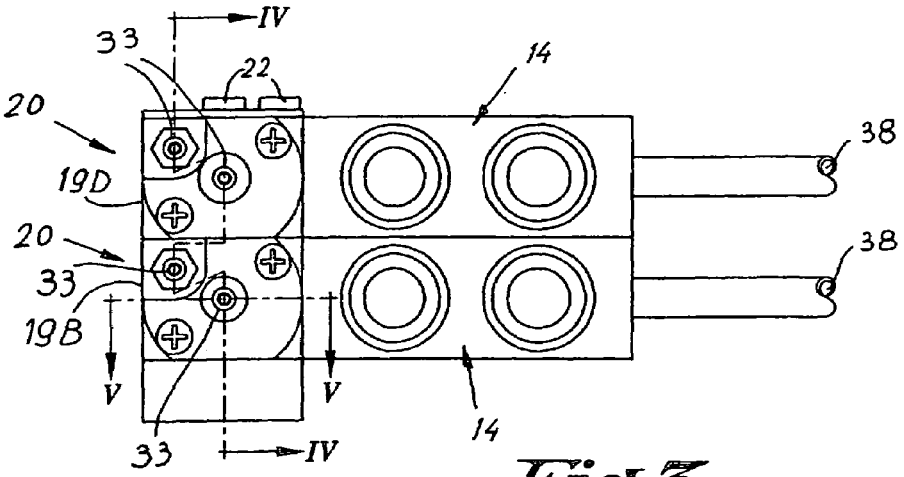
FIG. 3 represents a view in the direction of arrow F3 in FIG. 2.
Figure 2:
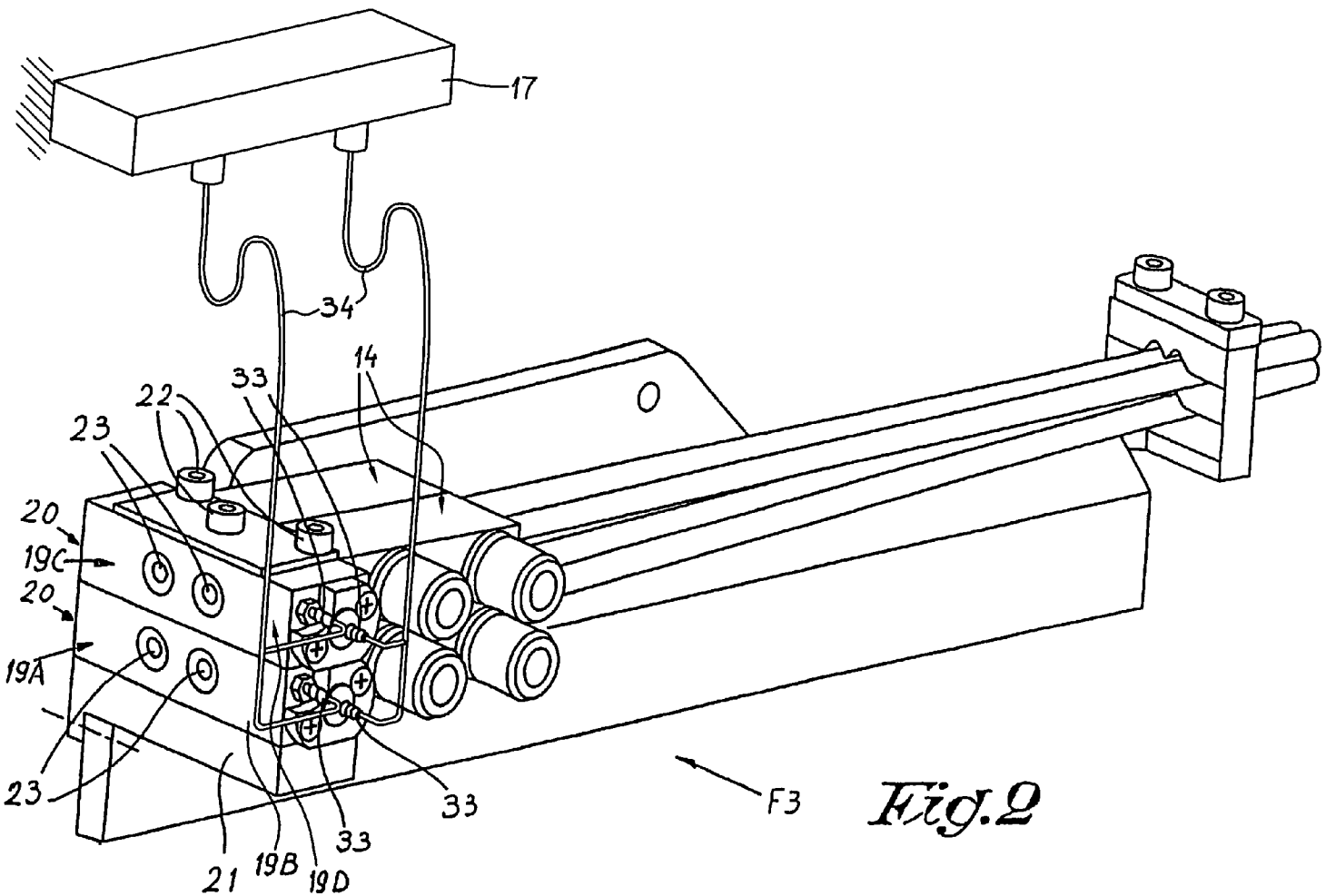
FIG.2 in perspective represents a view of a practical form of the invention, viewed in the direction of arrow F2 in FIG. 1.

FIGS. 2, 3 and 5 also show that the elements 20 configured in a modular manner preferably are formed as complete attachable and detachable assemblies which are arranged along the direction of a main blower 14, whereby each respective thread clamp 19A–19B–19C–19D comprises a thread passage 23 (also referred to as a "weft thread feeding channel") in the form of a thread-feeding channel situated along the direction of and forming an extension of the thread-feeding channel 38 (also referred to as a "thread clamp thread passage") of the corresponding main blower 14.

More particularly, the thread-feeding channels 23, 38 of the respective thread clamps 19A–19B–19C–19D and the corresponding main blower 14 are connected to each other, with which it is meant that they, so to speak, function as one channel.

As represented in FIG. 5, the necessary sealing means, such as sealing rings 39, can be provided therebetween.

As is clearly visible in FIGS. 2 and 4, all pneumatic connections 33 preferably are situated at one and the same side of the element 20 configured in a modular manner, more particularly at the side of the weaver, such that they are easily accessible and that moreover no hampering connections and conduits are present at the rear side.

The fact that conduits 34 are fixed facing the side towards of the weaver, does not only have the advantage that they are easily accessible for manipulation and maintenance, however, it is also advantageous from the point of shiftability, i.e. movability according to the longitudinal direction of the sley 8. If the conduits 34 should give out at the underside, during "shifting" they would be hindered by the sley 8 situated therebelow. If they give out at the rear side, then, during "shifting", at a certain position they might come into contact with the weaving frames 6. Conduits at the upper side, in fact, are possible, however, providing them facing towards the weaver is preferred as this is optimum for bringing all connections, also those of the main blowers, then to one and the same side. Connections facing towards the weaver allow configuring the whole module in a simple manner.

In FIG. 1, the central system with the associated valves 35 are represented schematically apart from the sley 8. In a practical form of the invention, they are mounted above the sley 8 next to each other on a block as shown in FIG. 2, such that exclusively two pneumatic conduits 34 towards the block with valves must be provided, for the overpressure and, the negative pressure, respectively. In that case, it is preferred that the valves 35 are mounted precisely above the elements 20 configured in a modular manner, whereby the connection of the thread clamps 19A–19B–19C–19D to the valves 35 then may take place by means of supple, upwardly bent conduits 34 between said connections 33 and the valves 35. The importance of conduits bending in a vertical plane lies in the fact that the sley 8 itself pivots in the vertical plane. Due to this arrangement of the conduits, these conduits, as a result of the movement of the sley, almost do not move out of the vertical plane in which they are situated. Therefore, these conduits can be arranged very close together, without letting them contact each other, which would cause them to wear through.

As schematically represented in FIG. 1, between the thread supply, more particularly the bobbins 12, and said main blower 14 attached on the sley 8, preferably a thread tensioner 40 per weft yarn 27 is present, more particularly a fixedly arranged thread tensioner 40 which is situated along the respective weft thread 27 between the magnetically actuatable pin 41 of the respective prewinder 13 and the main blower 14. In the case that, as represented, also auxiliary main blowers 15 are applied, the respective thread tensioners 40 preferably are situated upstream in respect to these auxiliary main blowers 15.

The construction and the use of the elements 20 configured in a modular manner can simply be deduced from the figures.

The construction consists in that, as aforementioned, the different elements 20 configured in a modular manner, which in their turn either may consist of several parts or not, systematically are provided on top of each other and are attached by means of said bolts 22. It is obvious that at random several modular elements 20 can be provided on top of each-other.

The modular construction allows to add thread clamps 19A–19B–19C–19D to the main blower 14, or possibly also the auxiliary main blower 15, when the weft yarns require clamps, and to remove them as this no longer is required. As a weft yarn no longer requires a clamp, the presence of an unused thread clamp 19A–19B–19C–19D in fact means an additional increase of complexity in respect to the wiring of the main blower and the cleaning of the components. Due to the modular extension or limitation of the whole, an optimized number of thread clamps always can be provided. An additional advantage consists in that the components for a 2-colour, a 4-colour or a 6-colour main blower always are the same and only a multitude of the applied components must be provided.

The functioning of the device 10 consists in that weft yarn 27 originating from the bobbins 12 is directed, in a known manner, by means of the prewinders 13 towards the auxiliary main blowers 15 and main blowers 14, whereby, by systematically releasing well-defined thread lengths, weft threads 5 are formed which are brought into the shed 7 by means of said blowers 14–15. At the moments when no weft threads 5 of a certain weft yarn 27 must be brought into the shed 7, the respective thread clamp 19A–19B–19C–19D preferably is closed, which is the case for thread clamps 19B–19C–19D in FIG. 4. In this manner, it is prevented that these weft yarns 27 drop with their extremity out of the respective main blowers 14.

At the moment when a weft thread 5 of a certain weft yarn 27 then must be inserted, the thread clamp 19A–19B–19C–19D concerned of course is opened, which is the case for the thread clamp 19A in FIG. 4.

The closing of the thread clamps 19A–19B–19C–19D takes place by applying an overpressure to the respective connections 33, whereas opening is performed by applying a negative pressure., such by means of the appropriate control of said valves 35.

As the weft yarns 27 are clamped in the closed thread clamps and the sley 8 moves to and fro, as a consequence of which the distance between the auxiliary main blowers 15 and the main blowers 14 is altered, the respective weft yarns 27 are drawn somewhat back from in between the thread clamps 19B–19C–19D, as a result of which the amount of yarn which is present between each respective prewinder 13 and thread clamp 19B–19C–19D becomes longer. Then, the aforementioned thread tensioners 40 ensure that the respective weft yarns 27 will not hang limply, as a result of which disadvantageous influences of such limply hanging thread parts are excluded. These thread tensioners 40 either can be controllable or not.

It is noted that the use of such thread tensioner 40 according to the invention also is useful in combination with other thread clamps mounted on the sley, irrespective whether those are thread clamps of said modular type, or others, and irrespective whether thread clamps are concerned which cooperate with a main blower 14 or an auxiliary blower 15 or not. Such thread tensioner, for example, also is useful in combination with a not-represented thread clamp which either is mounted at the starting end of the shed 7, or the other end of the shed 7, or on any other place on the sley.

According to another form of the invention, which hereafter will be described in more detail by means of the schematic representation in FIG. 6, the device 10 is characterized in that it comprises air supply means 42 which allow that at the main blower 14, an air supply of at least two pressures can be provided, an insertion pressure and a lower pressure, respectively, whereby these air supply means 42 comprise control means 43, which can form a part of said control unit 17 and which can provide for that, when opening the thread clamp 19A–19B–19C–19D and before the insertion of a weft thread 5 by means of the insertion pressure, at least temporarily an air supply to the respective main blower 14 is provided at said lower pressure.

Figure 6:
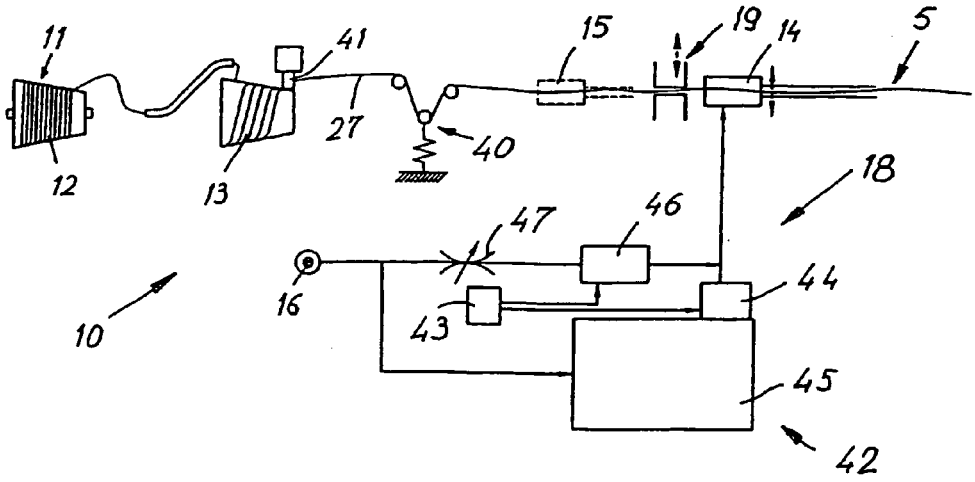
FIG. 6 schematically represents another device according to the invention.

As represented in FIG. 6, these air supply means 42 per weft yarn 27 consist of a valve 44 with which the high insertion pressure can be applied at the respective main blower 14, for example, by the intermediary of a buffer vessel 45, and a valve 46 with which said lower pressure can be applied at the respective main blower 14, which lower pressure, for example, is obtained by the intermediary of a reduction valve 47.

It is clear that by means of an appropriate control synchronized with the respective thread clamp 19, which in FIG. 6 is represented only schematically, but which in reality consists of one of the thread clamps 19A–19B–19C–19D, as well as of the valves 44–46, a control, as aforementioned, can be provided, in other words, such that when opening the thread clamp 19 and before the insertion of a weft thread 5 by means of the insertion pressure, at least temporarily an air supply to the respective main blower 14 is provided at said lower pressure. This offers the advantages mentioned in the introduction.

In the most preferred form of embodiment, an actuation cycle will be provided which successively comprises the following steps:

closing the thread clamp 19 at the end of the insertion;

interrupting, by means of valve 44, the further air supply at insertion pressure, whereas also no longer air at low pressure is supplied through valve 46;

when performing an insertion, supplying air at low pressure through valve 46, whereby the switching-on thereof already takes place before opening the thread clamp 19;

opening the thread clamp 19, such that the weft thread can move;

applying the insertion pressure, together or approximately together with the opening of the thread clamp 19; and closing again, when opening the thread clamp 19 or shortly thereafter, the valve 46 for the low pressure.

It is clear that this technique is not limited to devices 10 which are equipped with thread claps 19A–19B–19C–19D which form a part of an element 20 configured in a modular manner, rather, according to the invention this technique can be applied in all devices 10 for inserting weft yarn 5 which comprise a main blower 14 or an auxiliary main blower 15 which is provided with a thread clamp of any kind.

Of course, for example, the modular construction of thread clamps 19 also can be applied with thread clamps which cooperate with a main blower arranged next to the sley 8, or in combination with an auxiliary main blower 15 which either is arranged next to the sley 8 or not.

The present invention is no way limited to the forms of embodiment described as an example and represented in the figures, on the contrary such device and method for inserting weft threads in a weaving machine, as well as the thread clamp 19A–19B–19C–19D applied therewith, may be realized according to different variants, within the scope of the invention.

The invention claimed is:

1. Device for inserting weft threads in an airjet weaving machine comprising at least one main blower for inserting weft threads into a shed, said at least one main blower including a blower weft thread feeding channel extending in a weft feeding direction; and a thread clamp modular assembly comprising at least one thread clamping device and at least one enclosed thread clamp thread passage cooperating respectively with the at least one thread clamping device such that each weft thread clamping device is arranged to selectively secure a weft thread contained in a respective thread clamp thread passage against feeding motion; said thread clamp modular assembly located directly upstream of said weft thread feeding channel of said at least one main blower with said at least one thread clamp thread passage in direct communication with a respective blower weft thread feeding channel such that each thread clamp thread passage and an associated blower weft thread feeding channel form a continuous weft thread feeding channel for a respective main blower.

2. Device as claimed in claim 1, wherein said device comprises at least two main blowers disposed laterally adjacent to each other relative to a weft feed direction, each blower including a respective blower weft thread feeding channel; and wherein said thread clamp modular assembly is a single assembly including two laterally adjacent thread clamps and two laterally adjacent enclosed thread clamp weft thread passages associated respectively with the thread clamps; each of said thread clamp weft thread passages disposed in direct communication with a respective one of said blower weft thread feeding channels.

3. Device as claimed in claim 1, including a weft thread clamp actuator within said thread clamp modular assembly operably associated with each weft thread clamp, each actuator comprising a movable element arranged to move transversely relative to a weft feed direction.

4. Device as claimed in claim 3, wherein said actuators are movable linearly and are disposed opposite each other for co-linear motion, and wherein said thread clamp thread passages are disposed so they extend between said actuators.

5. Device as claimed in claim 3, each movable element comprising a reciprocable piston movable within a respective cylinder chamber, said piston also comprising a movable clamp member arranged to cooperate with a relatively fixed clamp element to engage a weft thread in a respective thread clamp thread passage between a respective movable clamp member and a relatively fixed clamp element for securing such weft thread against feeding motion.

6. Device as claimed in claim 5, including means for supplying pressurized air and suction to a single side of each piston for actuating the piston within the piston chamber between weft thread clamping and unclamping positions.

7. Device as claimed in claim 5, wherein each clamp member comprises an end of a respective piston.

8. Device as claimed in claim 6, said means for supplying pressurized and suction to a single side of each piston comprising a common port for both pressurized air and suction.

9. Device as claimed in claim 5, said movable clamp member movable in a direction transversely relative to a weft feeding direction to engage and clamp a weft thread relative to a respective fixed clamp element.

10. Device as claimed in claim 8, including multiple main blowers each associated with at least one thread clamp modular assembly containing multiple ones of said respective thread clamping device cooperating with a respective weft feeding channel communicating with a respective main blower, and wherein the common ports of said weft clamp modular assembly are all located on the same side of the weft clamp modular assembly, said side being located transversely of a weft feeding direction.

11. Device as claimed in claim 1, said at least one main blower mounted on a sley of a weaving machine for movement therewith and a respective thread clamp modular assembly connected with the at least one main blower and movable together with the at least one main blower and the sley.

12. Device as claimed in claim 11, wherein each weft thread clamping device is pneumatically actuated; and a control valve arranged to selectively control flow of air for actuating each clamping device synchronously with a weft insertion cycle of the weaving machine; said control valve located above the sley and communicating with respective air conduits connected to each thread clamp modular assembly for supplying actuating air to said clamping devices.

13. Device as claimed in claim 11, including a thread supply and a tensioner disposed upstream from the at least one main blower and the cooperating thread clamp modular assembly relative to a weft feeding direction between the thread supply and the at least one main blower.

14. Device as claimed in claim 13, wherein the position of said thread tensioner is fixed relative to the movable at least one main blower and the cooperating modular assembly.

15. Device as claimed in claim 1, including a weft insertion air supply arrangement and a weft insertion air controller arranged to control flow of air to said weft insertion air supply arrangement, and to regulate the flow of weft insertion air to said insertion air supply arrangement between a high insertion pressure and a lower pressure; said controller arranged such that when the at least one thread clamping device is in an unclamping position and before insertion of a weft thread using said high insertion pressure, the air supply is controllable by said controller so as to supply said lower pressure to the at least one main blower, and such that when said at least one clamping device is in the clamping position, the air supply is controllable by said controller so that the flow of air to the thread clamping device is substantially stopped for a preselected time.

16. A method of inserting weft threads in the shed of an airjet weaving machine wherein each weft thread is supplied from a thread supply and is blown into the shed my means of pressurized air supplied to at least one main blower; and further wherein each weft thread is held against feeding motion at least temporarily by a thread clamp; and further wherein the weaving machine includes a sley; and wherein said thread clamp is attached to and movable with said sley; comprising the step: tensioning the weft thread outside the shed at a location between the thread supply and the thread clamp, whereby intermittent slack produced in the weft thread during sley motion may be taken up by the tensioner.

17. Method of inserting weft threads in the shed of an airjet weaving machine wherein each weft thread is inserted into a shed by a main blower cyclically supplied with weft insertion air pressure and wherein a weft thread clamp movable between clamping and unclamping positions is provided to secure each weft thread against insertion motion through the main blower before it is inserted into a shed; and including a weft insertion air supply arrangement and a weft insertion air controller arranged to control flow of air to said weft insertion air supply arrangement so as to regulate the flow of weft insertion air to said weft insertion air supply arrangement between a high insertion pressure and a lower pressure; comprising the step: when the thread clamp is moved to an unclamping position and before the main blower is supplied with weft insertion air pressure, at least temporarily supplying lower pressure air to the main blower, and when the thread clamp is moved to the clamping position, substantially completely interrupting the flow of weft insertion air for a predetermined time period.

18. Device for inserting weft threads in an airjet weaving machine including a sley; said device including at least one main blower and a cooperating at least one thread clamp associated with the respective main blower; said at least one thread clamp configured as a modular assembly; said at least one main blower and said at least one thread clamp mounted on said sley; and wherein each at least one thread clamp is provided with a pneumatically actuated actuator; an air flow controller valve arrangement associated with said actuator; and wherein said valve arrangement is located above the sley.

* * * * *